United States Patent [19]

Wurfel

[11] Patent Number: 4,689,139

[45] Date of Patent: Aug. 25, 1987

[54] PROCESS FOR THE HYDROGENATION OF COAL

[75] Inventor: Helmut Wurfel, Blieskastel, Fed. Rep. of Germany

[73] Assignee: GfK Gesellschaft fur Kohleverflussigung mbH, Fed. Rep. of Germany

[21] Appl. No.: 832,936

[22] Filed: Feb. 26, 1986

Related U.S. Application Data

[63] Continuation of Ser. No. 642,682, Aug. 6, 1984, abandoned.

[51] Int. Cl.[4] ..... C10G 1/06

[52] U.S. Cl. ..... 208/415; 208/419; 208/430; 208/433

[58] Field of Search ..... 208/112, 10

[56] References Cited

U.S. PATENT DOCUMENTS

| | | | |
|---|---|---|---|
| 3,503,867 | 3/1970 | Ludlom et al. | 208/10 |
| 3,954,596 | 5/1976 | Schroeder | 208/10 |
| 4,045,329 | 8/1977 | Johanson et al. | 208/10 |
| 4,077,867 | 3/1978 | Aldridge et al. | 208/10 |
| 4,152,244 | 5/1979 | Raichle et al. | 208/8 R |
| 4,222,844 | 9/1980 | Nizanoff | 208/8 LE |
| 4,222,846 | 9/1980 | Schmid | 208/8 LE |
| 4,300,996 | 11/1981 | Kuehler | 208/421 X |
| 4,372,838 | 2/1983 | Kulik et al. | 208/10 |
| 4,421,632 | 12/1983 | Würfel | 208/10 |
| 4,437,973 | 3/1984 | Huibers et al. | 208/10 |
| 4,465,587 | 8/1984 | Gorg et al. | 208/112 |
| 4,468,315 | 8/1984 | Romberg | 208/10 |
| 4,492,623 | 1/1985 | Würfel | 208/10 |

*Primary Examiner*—Andrew H. Metz
*Assistant Examiner*—William G. Wright
*Attorney, Agent, or Firm*—James C. Wray

[57] ABSTRACT

In a process for hydrogenation of coal, comprising a sequence of reaction steps, connected in series, in which finely divided coal is mixed with oil and pumped to pressure, subsequently is heated to the hydrogenation starting temperature and then is subjected to catalytically activated hydrogenation, in the presence of hydrogen, wherein at least part of the heat required for heating is transferred to the coal by direct heat exchange with the hot product vapors; thereafter extracting a portion of the liquid intermediate product present in the reaction step downstream of the last reaction stage, and feeding, at least part of such product to the coal slurry which has been pumped to pressure. Preferably, the first reaction step is a preliminary reactor and the liquid intermediate product is fed to the coal slurry together with the hot product vapors. In an intermediate separator downstream from the mixing zone, the uncondensed portion of the product vapors, remaining after the heat exchange of the slurry with the gases and vapors withdrawn from the heated coal slurry, is separated from the slurry and passed to further hydrogenating purification.

17 Claims, 1 Drawing Figure

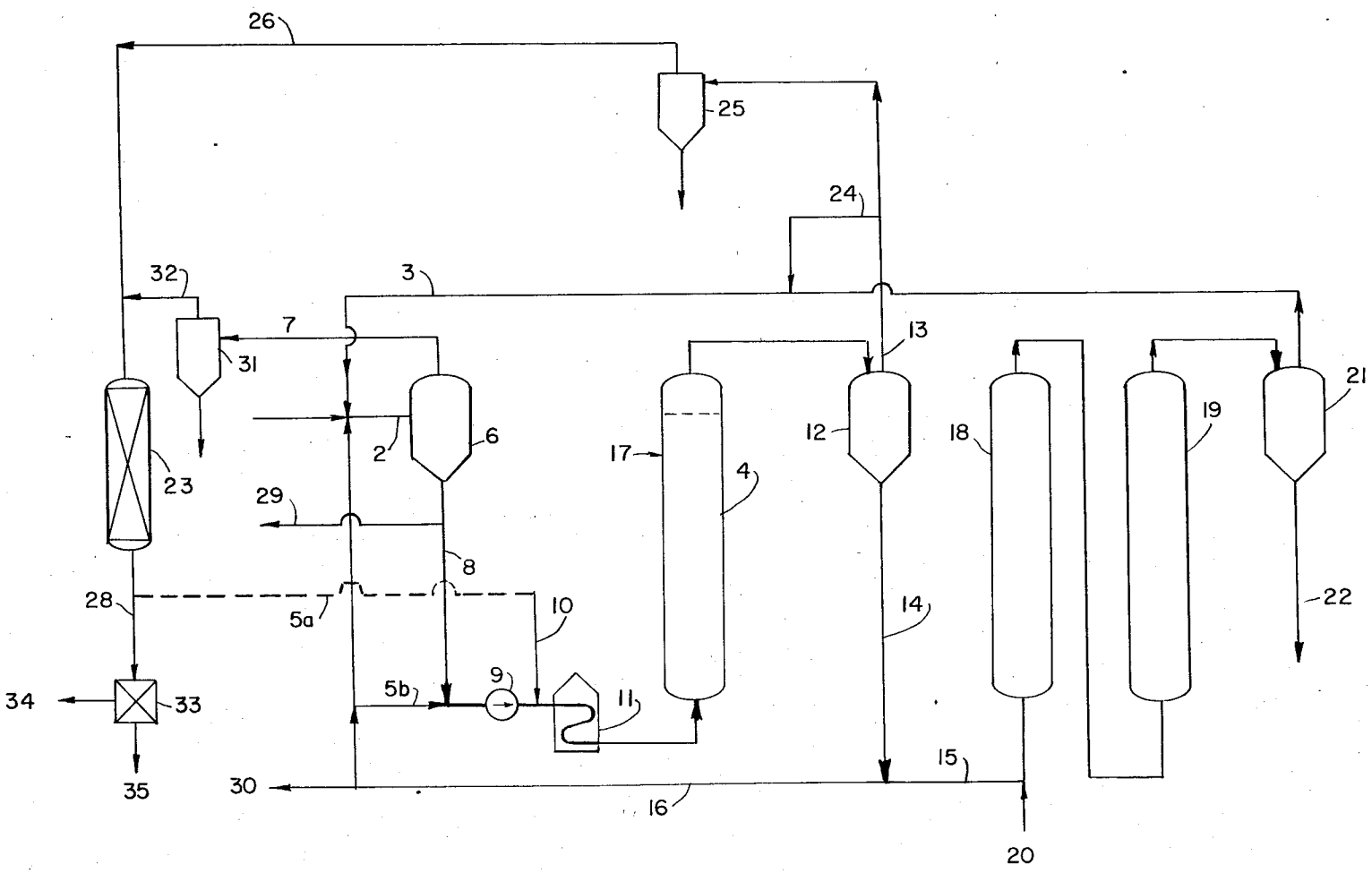
21
22
19
18
20
15
13
14
12
24
25
4
17
16
11
10
9
6
8
3
2
5b
5a
7
29
30
26
31
32
23
33
28
35
34

PROCESS FOR THE HYDROGENATION OF COAL

This application is a continuation, of application Ser. No. 642,682, filed 8-6-84 now abandoned.

The invention relates to a process for the hydrogenation of coal comprising a sequence of reaction steps connected in series, in which process finely divided coal is mixed with oil and pumped to pressure, subsequently heated to hydrogenation starting temperature and then is subjected to catalytically activated hydrogenation in the presence of hydrogen, wherein at least part of the heat required for heating is transferred to the coal by direct heat exchange with the hot product vapors.

It is known to add recycled hot vapor and gas products to the slurry for the purpose of heating it in a pressurized coal hydrogenation process. Such procedure results, on one hand, in the condensation of the high boiling residual fractions of the hot product vapors, which together with the coal slurry are reintroduced into the hydrogenation reactor. On the other hand, a portion of the low-boiling fraction contained in the coal paste is expelled, which fraction, together with the uncondensed product vapors, is separated from the coal slurry.

The heat resultant from the mixing of the coal slurry with the vapor and gas products of the slurry is frequently insufficient to initiate hydrogenation reaction necessitating the provision of supplemental heat to the slurry.

Heating of the slurry in the heat exchangers presents considerable difficulties. The high viscosity of the coal slurry prevents a uniform coating of the heat exchanger surfaces, and the high temperature prevailing in the heat exchangers causes expansion of the coal suspended in the slurry. This in turn results in a pulsating passage of the slurry through the heat exchangers, causing pressure surges and increased wear on equipment.

Subsequent processing of gases and vapors, extracted after direct heat exchange of the slurry with the hot product vapors, is extremely costly. The gas fraction still remaining after separation of the oils has to undergo an oil wash prior to the separation process into a hydrogen-rich gas which can be returned to the hydrogenation process, and a residual gas low in hydrogen.

The gases and vapors which result from further heating of the slurry in the heat exchanger, pass to the hydrogenation reactor with the slurry. This leads to a thinning of the hydrogen in the reactor due to the space requirement of the gases, and further leads to a reduction in the coal slurry feed capacity.

The low-boiling oils introduced into the reactor with the slurry do not participate in the actual hydrogenation reaction. However, due to the prevailing high temperatures, they are further fractionated and consume hydrogen, whereby additional undesirable gaseous compounds are formed.

It is the objective of the present invention to provide a cost-effective process for the hydrogenation of coal which reduces equipment costs.

This objective is achieved by the process of the invention in that a portion of the liquid intermediate product is extracted in a reaction step upstream of the last reaction stage, and at least in part, is fed to the coal slurry which has been pumped to pressure.

It is preferred that the first reaction step is a preliminiary reactor, and that following this reaction step a portion of the liquid intermediate product is withdrawn and added to the coal slurry.

At least part of the recycled liquid intermediate product can be added to the slurry together with the hot product vapors. The uncondensed portion of the product vapors, remaining after heat exchanging the slurry with the hot product vapors and with the gases and vapors withdrawn from the heated slurry, is subsequently separated and, according to another feature of the invention, is passed to further hydrogenating purification without reduction in pressure.

The hydrogen-rich gases remaining after purification are passed to the heated coal slurry before it is introduced into the preliminiary reactor, while fresh hydrogen ordinarily is only added before the subsequent hydrogenation step. The exothermic heat incurred in the hydrogenating purification of the extracted gases expediently is utilized by indirect heat exchange for the preheating of the fresh hydrogen which is to be introduced into the hydrogenation process.

According to the process of the invention, an amount of recycled liquid intermediate product, with the product vapors, is added to the slurry, which permits that the area of the slurry's highest viscosity can be passed through safely and quickly. Additional recycled liquid intermediate product can be mixed with the slurry before introduction to the preliminiary reactor for adjustment of the starting temperature of the preliminiary reactor. If the heat content of the product vapors is adequate for safe and fast passage of the area of highest viscosity, the addition of liquid intermediate product with the product vapors can be omitted.

The process of the invention affords heating of the coal slurry without conditioning it and without the addition of external heat, to the utmost extent. As the requirement for hydrogen in the preliminiary reactor is low, the hydrogen-rich gases remaining after the nydrogenating purification of the extracted gasea and vapors can be directly returned to the preliminiary reactor. This results in the elimination of the costly oil wash procedure during the separation of this gas phase into hydrogen-rich and hydrogen-poor residual gases.

The invention is further described by way of the example in the schematic drawing.

In the process depicted in the drawing, hydrogenation of coal is effected in several reaction stages 4, 18, 19 connected in series. The first reaction stage 4 is operated as a preliminiary reactor. Intermediate separator 12 for separation of the gases and vapors from the liquid intermediate product contained therein is downstream from reaction step 4. Alternatively, the head of preliminiary reactor 4 may be designed as a separator.

Dried coal slurry heated to about 150° to 200° C., consisting of about 60%–70% coal is passed under process pressure into a mixing zone 2 through line 1 and there is directly heat exchanged through line 3 with recycled hot product vapors from heat separator 21 located downstream of the last reaction step 19, and with recycled liquid intermediate product reintroduced through lines 14, 16 and 5*a* from intermediate separator 12. The temperature of this liquid intermediate product is approximately 440° to 470° C.

The amount of liquid intermediate product added to the coal slurry with the product vapors is regulated so that the coal slurry is heated to a temperature of approximately 360° to 400° C. and it must be high enough that the expansion area of the coal, i.e. the zone of highest viscosity, which is in the temperature range of 280° to 360° C., occurs within mixing zone 2.

The portion of the product vapors which did not condense during the heat exchange and the gases and vapors extracted from the heat coal slurry are separated from the slurry in separator 6, downstream from mixing zone 2, and are withdrawn through line 7.

The remaining heated coal slurry of lower viscosity is passed through line 8 to pump 9 which conveys it to preliminiary reactor 4 through line 10 with added hydrogen. As the hydrogen required in preliminary reactor 4 is not very high, it is sufficient to add hydrogen-rich gases instead of pure hydrogen.

Before the slurry enters pump 9 through line **5*b*, additional recycled liquid intermediate product from intermediate separator 12 can be added to ensure a starting temperature in the the preliminiary reactor 4** of approximately 290° to 430° C.

Furnace 11, upstream of preliminiary reactor 4, nearly serves to heat the slurry to the starting temperature of the preliminiary reactor in case of operational disturbances or during general start-up of the hydrogenation plant. During normal hydrogenation operation, furnace 11 is merely kept in a state of readiness.

The reaction heat generated causes an autothermic heating up of the mixture of coal slurry and hydrogen or hydrogen-rich gas, respectively. Preferably, the reaction in prelininiary reactor 4 is controlled such that a temperature of 440° to 470° C. is reached in the lower two-thirds of preliminiary reactor 4, which can then be kept constant by adding cold gas through line 17 in the upper third of the reactor.

Gases and vapors are separated in sepatator 12 from the anhydrous slurry exiting from preliminiary reactor 4 and are withdrawn through line 13.

A portion of the liquid intermediate product drawn off from separator 12 through line 14 is separated and fed to the slurry via lines 16, **5*a* or 5*b* respectively. The remainder of the liquid preliminary product is passed to additional hydrogenation stages 18 and 19, with the addition of preheated fresh hydrogen, through line 20 and is hydrogenated in a conventional manner. The entire amount of hydrogen required for the hydrogenation of coal and the hydrogenating purificication 23 is introduced through line 20**.

As the intermediate product passed to hydrogenation stages 18 and 19 has been freed of all gases and vapors which had formed having temperatures of up to 400° to 470° C., these hydrogenation reactors can be operated with a substantially increased capacity. Moreover, the reaction pressure of these gases and vapors can be reduced by the amount of partial pressure.

The gases and vapors exiting from preliminiary separator 12 expediently are fed to the hot product vapors from heat separator 21 through line 24.

The gases and vapors withdrawn from separator 6, which contain uncondensed portions of the hot product vapors, and if indicated, the gases and vapors withdrawn from separator 12, are passed directly to further hydrogenating purification step 23 without loss of pressure, along with the extracted low-boiling fractions from the heated slurry, after components, which may be entrained, like heavy oil or slurry particles which have a catalyst retardent effect, have been removed in separation device 31.

The gases and vapors exiting from intermediate separator 12 can also partially or entirely be passed directly to further hydrogenating purification 23, through line 26 from separator 25, in which high-boiling residuals of the oil are separated.

According to the process of the invention, the coal slurry can be passed to mixing zone 2 with a relatively high viscosity, i.e., requiring only a small amount of oil. The required amount of oil is provided by the vacuum oil recovered from the product of the heat separator 21, through line 22, as well as the oil quantities in dividing device 31 and separator 25. Requirements exceeding these amounts can either be made up by portions of the recycled liquid intermediate product reintroduced through line 30, and/or freshly heated slurry having a low viscosity can be recycled as pasting oil through line 29.

As the gases and vapors withdrawn through line 26 and 32 ordinarily do not contain any constituents of oil, they can now undergo, without loss of pressure, subsequent hydrogenating purification, as for example, solvent refining. Conventionally, solvent refining involves that oxygen compounds, among others, are annihilated, i.e. phenolic tar acids are converted into corresponding aromatic hydrocarbons. However, the oxygen compounds contained in the oil have a positive effect on the disintegration of the coal.

The product stream exiting from purifier 23 through line 28 is subsequently subjected to distillation. As the oils have a high affinity to the hydrocarbon gases, as for instance, methane or ethane, respectively, the remaining gas is substantially free of such compounds but has a very high hydrogen content. This hydrogen-rich gas can be added directly to the heated coal slurry through line 10, and together therewith can be passed to prelininiary reactor 4. The hydrogen content of this gas is sufficient to meet the hydrogen requirement of preliminiary reactor 4. The recycling step of the gas in the hydrogenation system eliminates the costly oil washing step.

In order to ensure that there is no buildup of circulating gases, even after prolonged operation, caused by the remaining residual hydrocarbons during the recirculating process, a liquid separating system 33, downstream of purification device 23, is expediently designed as a gas washing step, and at least part of the gas undergoes supplemental washing utilizing product from purification 23 as washing oil. The purified gas withdrawn through line 34 is returned to the unpurified partial stream and added to the heated slurry through line 10. A small high boiling fraction with a boiling range of approximately 350° to 450° C. can be withdrawn from the sump of the distillate unit and mixed with the oil. While this fraction does not contain any coal dissolving phenols, it is rich in hydrogen, thus enhancing the donor properties of the oil.

Another variation of this process provides that this fraction is recycled to heat separator 21. The sump product of heat separator 21, if indicated, undergoes coking after separation of the lower boiling distillates.

However, the high boiling fraction withdrawn from the distillate can also be directly subjected to the coking process.

The temperatures in purification device 23, in which cracking reactions can also occur, preferably is approximately 380° to 430° C. As the reaction is exothermic, there can be an adjustment to a higher temperature by increasing the throughput to be fractionated. Exothermic surplus heat incurred in purification step 23 expediently is utilized for the heating of fresh hydrogen introduced into the hydrogenated system.

The process also permits easy adaption of purification system 23 for treatment of oils from other sources, outside the system.

According to a variation of the invention, only a partial stream of the coal slurry is heated in mixing zone 2 and is passed through preliminiary reactor 4, while the second partial stream is directly introduced into hydrogenation step 18 immediately following preliminiary reactor 4, i.e. at one or several points above the inlet of the first partial stream. This second partial stream is heated to the starting temperature of the hydrogenation within this hydrogenation step by the exotheric heat incurred there.

The process of the invention is not limited to the hydrogenation of coal. It can be easily adapted to the hydrogenation of other carbon-containing feed material, as for instance, heavy oils, coal tar, tar and tar sand.

I claim:

1. In a process for the hydrogenation of coal in a sequence of reaction steps connected in series in which a finely divided coal is mixed with oil to form a slurry which is passed to a mixing area under process pressure and heated to hydrogenation starting temperature in the mixing area in part by heat exchange with hot product vapors, the improvement comprising:

separating hot liquid intermediate product with separation means disposed downstream of an initial reaction step at process pressure at a temperature of between 440–470 degrees Centigrade, and feeding at least a portion of the intermediate product back at process pressure to the slurry upstream of the initial reaction step, wherein the intermediate product constitutes a partially hydrogenated coal slurry, whereby hydrogenation starting temperature is achieved without outside heating sources by the hot vapors and the hot intermediate product.

2. Process according to claim 1, characterized in that the liquid intermediate product is withdrawn after the first reaction step.

3. Process according to claim 2, characterized in that the first reaction step is a preliminary reactor.

4. Process according to claim 2, characterized in that at least a portion of the recycled liquid intermediate product is fed to the coal slurry together with the hot product vapors and that the product vapors which did not condense during the heat exchange with the coal slurry, as well as the gases and vapors withdrawn from the heated coal slurry, are separated therefrom.

5. Process according to claim 2, characterized in that at least a portion of the recycled liquid intermediate product is fed directly to the coal slurry before passage thereof into the first reaction stage.

6. Process according to claim 2, characterized in that a portion of the separated liquid intermediate product is mixed with the finely divided feed coal as a pasting oil.

7. Process according to claim 4, characterized in that the separated gases and vapors are passed to further hydrogenating purification without reduction in pressure.

8. Process according to claim 7, characterized in that exothermic heat incurred in the hydrogenating purification by indirect heat exchange is transferred to the fresh hydrogen which is to be introduced into the hydrogenation process.

9. Process according to claim 7, characterized in that the entire fresh hydrogen required for the hydrogenation of coal and the hydrogenating purification is added to the coal slurry after the preliminary reactor step.

10. Process according to claim 7, characterized in that the gases with a high hydrogen content, remaining subsequent to hydrogenating purification, are added to the heated coal slurry before its passage into the preliminary reactor.

11. Process according to claim 10, characterized in that at least part of the gases is passed through a washing step and that products resulting from the hydrogenating purification are used as a washing oil.

12. Process according to claim 7, characterized in that there is a distillation step downstream from the hydrogenating purification and that the highest boiling oil fraction is withdrawn and returned to the hydrogenation plant.

13. Process according to claim 12, characterized in that the oil fraction is added to the fresh coal as paste producing oil.

14. Process according to claim 12, characterized in that the oil fraction is returned to the heat separator, and the sump product can be subjected to coking, after separation of the lower-boiling distillate.

15. Process according to claim 12, characterized in that the oil fraction is passed directly to the coking process.

16. A process for the hydrogenation of coal in a sequence of reaction steps connected in series comprising:

passing a coal slurry to a mixing zone under pressure, heating the slurry to hydrogenation starting temperature in part with hot product vapors taken downstream of a final reaction step and added to a mixing area upstream of an initial reaction step and in part with recycled liquid intermediate product taken downstream of the initial reaction step at a temperature of between 440–470 degrees Centigrade and added to the mixing area, and passing the heated coal slurry to the initial reaction stage with a hydrogen-rich gas for hydrogenation of the slurry.

17. The process of claim 16 further comprising:

regulating the amount of liquid intermediate product added to the coal slurry to achieve a coal slurry temperature of approximately 360–400 degrees centigrade.

* * * * *

UNITED STATES PATENT OFFICE
CERTIFICATE OF CORRECTION

Patent No. 4,689,139 Dated August 25, 1987

Inventor(s) Helmut Wurfel

It is certified that error appears in the above-identified patent and that said Letters Patent are hereby corrected as shown below:

On the Title Page, please insert the following:

[30] Foreign Application Priority Data

Dec. 16, 1982 [DE] Fed. Rep. of Germany .. 3246609

Aug. 12, 1983 PCT ..... PCT/DE83/00202

Signed and Sealed this

Nineteenth Day of January, 1988

*Attest:*

DONALD J. QUIGG

*Attesting Officer*

*Commissioner of Patents and Trademarks*